US011608208B2

(12) United States Patent
Leng

(10) Patent No.: US 11,608,208 B2
(45) Date of Patent: Mar. 21, 2023

(54) ASSEMBLABLE STORAGE BOX

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Fujian (CN)

( * ) Notice: Subject to any disclaimer, the term of this patent is extended or adjusted under 35 U.S.C. 154(b) by 153 days.

(21) Appl. No.: 17/063,690

(22) Filed: Oct. 5, 2020

(65) Prior Publication Data

US 2021/0016922 A1 Jan. 21, 2021

Related U.S. Application Data

(63) Continuation of application No. PCT/CN2019/080976, filed on Apr. 2, 2019.

(30) Foreign Application Priority Data

Apr. 3, 2018 (CN) ..... 201820465365.5
Apr. 3, 2018 (CN) ..... 201820466837.9
(Continued)

(51) Int. Cl.
*B65D 6/24* (2006.01)
*B65D 6/34* (2006.01)
(Continued)

(52) U.S. Cl.
CPC ..... *B65D 11/1873* (2013.01); *B65D 11/26* (2013.01); *B65D 43/167* (2013.01);
(Continued)

(58) Field of Classification Search
CPC ..... B65D 11/1873; B65D 2301/20; B65D 11/26; B65D 43/167; B65D 43/24;
(Continued)

(56) References Cited

U.S. PATENT DOCUMENTS 1,485,954 A 3/1924 Brasch
3,374,915 A * 3/1968 Verhein ..... B65D 88/528 220/4.28
(Continued)

FOREIGN PATENT DOCUMENTS

CN 2517302 Y 10/2002
CN 2659227 Y 12/2004
(Continued)

*Primary Examiner* — Shawn M Braden
(74) *Attorney, Agent, or Firm* — Cooper Legal Group, LLC

(57) ABSTRACT

The present disclosure discloses an assemblable storage box. A box body comprises a bottom plate and four side plates, the four side plates comprise a front side plate, a rear side plate, a left side plate, and a right side plate, two adjacent side plates of the four side plates are detachably clamped together, bottom portions of the four side plates are disposed with support countertops, four sides of the bottom plate horizontally extend outward to define positioning edges, the positioning edges of the four sides of the bottom plate respectively abut the support countertops of the four side plates, and the positioning fasteners are fastened to the support countertops to enable the positioning edges to be positioned relative to the support countertops.

21 Claims, 11 Drawing Sheets

(30) Foreign Application Priority Data

| | | |
|---|---|---|
| Apr. 3, 2018 | (CN) | 201820466880.5 |
| Apr. 3, 2018 | (CN) | 201820467034.5 |
| Apr. 3, 2018 | (CN) | 201820472588.4 |
| Apr. 3, 2018 | (CN) | 201820480545.0 |

(51) Int. Cl.
*B65D 43/16* (2006.01)
*B65D 43/24* (2006.01)

(52) U.S. Cl.
CPC .... *B65D 43/24* (2013.01); *B65D 2543/00231* (2013.01); *B65D 2543/00296* (2013.01); *B65D 2543/00574* (2013.01)

(58) Field of Classification Search
CPC ..... B65D 2543/00231; B65D 2543/00296; B65D 2543/00574
See application file for complete search history.

(56) References Cited

U.S. PATENT DOCUMENTS

| | | | | |
|---|---|---|---|---|
| 4,696,412 | A | 9/1987 | McGowan | |
| 5,092,093 | A | 3/1992 | Lu | |
| 5,152,591 | A | 10/1992 | Beals | |
| 5,868,081 | A | 2/1999 | Raab | |
| 5,947,037 | A | 9/1999 | Hornberger et al. | |
| 6,058,853 | A | 5/2000 | Pinch et al. | |
| 6,343,454 | B1 | 2/2002 | Fisher | |
| 8,499,954 | B2 * | 8/2013 | Tang | B65D 19/06 220/489 |
| 9,808,081 | B2 | 11/2017 | Leng | |
| 10,932,560 | B2 | 3/2021 | Leng | |
| 11,421,823 | B2 | 8/2022 | Leng | |
| 2003/0230042 | A1 | 12/2003 | Rhodebeck | |
| 2008/0157571 | A1 | 7/2008 | Richardson | |
| 2008/0295454 | A1 | 12/2008 | Leng | |
| 2009/0324872 | A1 | 12/2009 | Leng | |
| 2010/0043681 | A1 | 2/2010 | Leng | |
| 2010/0108669 | A1 | 5/2010 | Yang | |
| 2010/0310811 | A1 | 12/2010 | Leng | |
| 2012/0117910 | A1 | 5/2012 | Chuang | |
| 2014/0197168 | A1 * | 7/2014 | Miller | B65D 88/528 220/4.33 |
| 2014/0319131 | A1 * | 10/2014 | Rees | B65D 11/1873 220/660 |
| 2016/0272363 | A1 * | 9/2016 | Matsuoka | B65D 11/186 |
| 2017/0225864 | A1 | 8/2017 | Kinskey | |
| 2019/0021484 | A1 | 1/2019 | Leng | |
| 2019/0193340 | A1 * | 6/2019 | Leng | B29C 66/022 |
| 2020/0187652 | A1 | 6/2020 | Leng | |
| 2020/0191331 | A1 | 6/2020 | Leng | |
| 2020/0323343 | A1 | 10/2020 | Leng | |
| 2020/0385167 | A1 * | 12/2020 | Ahmed | B65D 85/187 |

FOREIGN PATENT DOCUMENTS

| | | | |
|---|---|---|---|
| CN | 1579889 | A | 2/2005 |
| CN | 201099397 | Y | 8/2008 |
| CN | 101520125 | A | 9/2009 |
| CN | 201761705 | U | 3/2011 |
| CN | 102987226 | A | 3/2013 |
| CN | 102987726 | A | 3/2013 |
| CN | 103213729 | A | 7/2013 |
| CN | 103263146 | A | 8/2013 |
| CN | 103284471 | A | 9/2013 |
| CN | 103625725 | A | 3/2014 |
| CN | 204021406 | U | 12/2014 |
| CN | 204280164 | U | 4/2015 |
| CN | 106617681 | A | 5/2017 |
| FR | 429197 | A | 9/1911 |
| FR | 2918858 | B3 | 7/2009 |
| FR | 2993540 | A1 | 1/2014 |
| GB | 2045339 | A | 10/1980 |
| JP | 2011514269 | A | 5/2011 |
| JP | 2013014378 | A | 1/2013 |
| JP | 202533140 | A | 11/2020 |
| JP | 2020531381 | A | 11/2020 |
| WO | 2016004342 | A1 | 1/2016 |
| WO | 2017045579 | A1 | 3/2017 |

* cited by examiner

ASSEMBLABLE STORAGE BOX

RELATED APPLICATIONS

This application is a continuation of and claims priority to International Patent Application PCT/CN2019/080976, filed on Apr. 2, 2019, which claims priority to Chinese patent application number 201820466880.5, filed on Apr. 3, 2018, Chinese patent application number 201820480545.0, filed on Apr. 3, 2018, Chinese patent application number 201820465365.5, filed on Apr. 3, 2018, Chinese patent application number 201820467034.5, filed on Apr. 3, 2018, Chinese patent application number 201820472588.4, filed on Apr. 3, 2018, and Chinese patent application number 201820466837.9, filed on Apr. 3, 2018. International Patent Application PCT/CN2019/080976, Chinese patent application number 201820466880.5, Chinese patent application number 201820480545.0, Chinese patent application number 201820465365.5, Chinese patent application number 201820467034.5, Chinese patent application number 201820472588.4, Chinese patent application number 201820466837.9 are incorporated herein by reference.

FIELD OF THE DISCLOSURE

The present disclosure relates to an assemblable storage box, in particular relates to an assemblable plastic storage box.

BACKGROUND OF THE DISCLOSURE

Storage boxes are an essential part of everyday life. The storage box can be used to store clothes, tools, daily necessities, etc., and the storage box can make the living environment more clean and tidy, especially when moving or traveling. It serves as a convenient place to put things.

Storage boxes are classified into wooden storage boxes, metal storage boxes and plastic storage boxes according to materials. The side plates of the wooden storage box are usually connected by a mortise and tenon structure, which does not enable the wooden storage box to be quickly disassembled and assembled, and the wooden storage box is heavy and has a high cost. Metal storage boxes are cumbersome and costly to produce. Metal storage boxes are mostly used as safes and are not suitable for storage of daily necessities. Most of the plastic storage boxes are integrally formed by plastic injection molding, therefore making plastic storage boxes lightweight and have low manufacturing cost, so plastic storage boxes are more widely used in life.

Existing plastic storage boxes have the following technical problems. First, the plastic storage boxes cannot be disassembled. Therefore, plastic storage boxes take up a large amount of space during both transportation and storage, which is not conducive to reducing transportation costs. Additionally plastic storage boxes are easily crushed during transportation. Second, the weight of a box cover of the plastic storage box is distributed to each side plate of the plastic storage box, and an upper edge of the front side plate of the plastic storage box has a large width and an entirety of the upper edge is suspended. When bearing a large weight, the front side plate of the plastic storage box is easily deformed and arches outwards, so the plastic storage box has a poor load-bearing capacity. Third, when the plastic storage box is used outdoors, rainwater can easily penetrate into the plastic storage box from a gap between the side plates of the plastic storage box, causing items stored in the plastic storage box to get wet. Therefore, the waterproof performance of the plastic storage box is not good. Fourth, after the box cover is open, the box cover hangs down on a back of the box body, and a turning angle of the box cover is very large, which is inconvenient to operate. In particular, the box cover cannot be opened at a desired angle according to user requirements, and the plastic storage box lacks functionality desirable to users.

BRIEF SUMMARY OF THE DISCLOSURE

The present disclosure provides an assemblable storage box that is easy to disassemble and assemble, which solves the first technical problem mentioned in the existing techniques. The technical solution of the present disclosure to solve the first technical problem is as follows.

An assemblable storage box comprises a box body comprising a top surface with an opening, a box cover configured to cover the opening of the box body, and positioning fasteners. The box body comprises a bottom plate and four side plates, the four side plates comprise a front side plate, a rear side plate, a left side plate, and a right side plate, two adjacent side plates of the four side plates are detachably clamped together, bottom portions of the four side plates are disposed with support countertops, four sides of the bottom plate horizontally extend outward to define positioning edges, the positioning edges of the four sides of the bottom plate respectively abut the support countertops of the four side plates, and the positioning fasteners are fastened to the support countertops to enable the positioning edges to be positioned relative to the support countertops.

In a preferred embodiment, the two adjacent side plates are clamped together by positioning columns and positioning holes, the positioning columns and the positioning holes are respectively disposed on one of the two adjacent side plates, free ends of the positioning columns comprise caps, the positioning holes are gourd shaped, and the caps of the positioning columns are configured to be disposed in and hung on narrower ends of the positioning holes from wider ends of the positioning holes.

In a preferred embodiment, the left side plate and the right side plate are clamped between the front side plate and the rear side plate, inner surfaces of the left side plate and the right side plate are disposed with the positioning columns, end faces of the front side plate and the rear side plate are disposed with the positioning holes, and the positioning holes comprises narrow tops and wide bottoms.

In a preferred embodiment, the four sides of the bottom plate are all folded upward to define block edges, and upper edges of the block edges horizontally extend outward to define the positioning edges.

In a preferred embodiment, the four side plates comprise rectangular frames and plates, four sides of the plates surround the rectangular frames, and upper surfaces of bottom edges of the rectangular frames define the support countertops of the four side plates.

In a preferred embodiment, the bottom plate is a blister board, and the bottom plate is disposed with honeycomb grooves.

In a preferred embodiment, a rear side edge of the box cover and a top edge of the rear side plate are both disposed with a connecting base, the connecting base of the box cover and the connecting base of the box body are connected together by a shaft core to enable the box cover to be rotated to be opened and to be closed, and the shaft core is detachable.

In a preferred embodiment, a first end of the shaft core is disposed with a cap, a second end of the shaft core is centrally symmetrically disposed with two elastic arms, opposite outer side walls of the two elastic arms are respectively disposed with positioning protrusions, and the cap and the positioning protrusions cooperate to clamp the connecting base of the box cover and the connecting base of the box body. When it is desired for the box cover to be rotatably connected to the box body, the positioning protrusions need only be radially pressed. The two elastic arms are brought close to each other, the second end of shaft core can pass through an axial hole of the connection base of box cover and an axial hole of the connection base of the box body, so that the two connecting bases are connected together, and it is convenient to use.

In a preferred embodiment, the positioning protrusions comprise front guide slopes and rear guide slopes. The guide slopes are provided to enable the shaft core to be transmitted between the positioning protrusions and the axial holes smoothly, and the shaft core is assembled and disassembled more smoothly and effortlessly.

In a preferred embodiment, a middle portion of an end surface of the second end of the shaft core is disposed with a V-shaped groove, and the V-shaped groove divides the second end of the shaft core into the two elastic arms.

In a preferred embodiment, the connecting base of the box cover and the box cover are fastened together, and the connecting base of the box body and the box body are fastened together.

In a preferred embodiment, an outer edge of a top surface of the rear side plate is disposed with a step groove, and the connecting base of the box body is disposed in the step groove.

In a preferred embodiment, the assemblable storage box comprises a U-shaped fastener with a downward opening. A rear side of the box cover is rotatably connected to the rear side plate, the U-shaped fastener is disposed below a middle portion of a front side of the box cover, and when the box cover is closed, the U-shaped fastener is fastened to an upper edge of the front side plate.

In a preferred embodiment, the assemblable storage box comprises a handle and a lock piece configured to be mated and connected to each other. An outer side of the upper edge of the front side plate comprises a step groove, the handle is rotatably connected to the U-shaped fastener, and the lock piece is disposed on an edge position of the step groove.

In a preferred embodiment, the box cover comprises a plastic panel and a plastic frame, four sides of the plastic panel is connected to the plastic frame, and the U-shaped fastener and the plastic frame are mated and connected to each other.

In a preferred embodiment, the front side plate comprises a rectangular frame and a plate, four sides of the plate surround the rectangular frame, the rectangular frame is disposed with a reinforcing rod, and the reinforcing rod is vertically disposed on a middle portion of the rectangular frame.

In a preferred embodiment, a splice gap is defined between the two adjacent side plates, the four side plates comprise rectangular frames and plates connected together, the rectangular frames are disposed along edges of four sides of the plates, and in the two adjacent side plates connected end-to-end: the rectangular frame of one side plate of the two adjacent side plates extends outward to define a side wing, and the side wing covers the splice gap between the two adjacent side plates from an outer side.

In a preferred embodiment, the plates are plastic blister boards, and the rectangular frames are hollow plastic members.

In a preferred embodiment, the four sides of the plates are bent inward to define folded edges, the folded edges surround the rectangular frames from the outer side, the rectangular frames are disposed with pressing edges, and the pressing edges press edges of the folded edges.

In a preferred embodiment, the left side plate and the right side plate are clamped by the front side plate and the rear side plate, and the rectangular frames of the front side plate and the rear side plate define the side wings.

In a preferred embodiment, a rear side of the box cover is rotatably connected to the rear side plate, a self-positioning structure is disposed between the box cover and the left side plate or the right side plate, the self-positioning structure comprises a support rod, a fixing base, and a friction block, the fixing base is disposed on the left side plate or the right side plate, the fixing base is disposed with a slide groove passing through an upper top surface and a lower bottom surface of the fixing base, the fixing base is further disposed with a receiving hole in communication with the slide groove, a first end of the support rod is pivotally connected to a side wall of the box cover, a second end of the support rod passes through the slide groove and extends out of the fixing base in a downward direction, the support rod is configured to slide and swing relative to the slide groove, the friction block is disposed in the receiving hole and is in friction connection with the support rod, a frictional force between the friction block and the support rod positions the support rod, and the support rod is configured to be pulled to move by overcoming the frictional force.

In a preferred embodiment, the assemblable storage box comprises an elastic member and a screw bolt. An inner surface of the receiving hole comprises an internal thread, the screw bolt cooperates with the internal thread, and two ends of the elastic member abut the friction block and the screw bolt respectively.

In a preferred embodiment, an end of the second end of the support rod is disposed with a positioning hook configured to prevent the support rod from being separated from the slide groove.

In a preferred embodiment, the box cover is disposed with a hinge base, and the first end of the support rod is pivotally connected to the hinge base.

In a preferred embodiment, the hinge base is disposed with a positioning pin, the box cover comprises a plurality of positioning holes configured to cooperate with the positioning pin, and the positioning pin is configured to be clamped to one of the plurality of positioning holes.

In a preferred embodiment, after the box cover is closed, the support rod is disposed in the box body.

In a preferred embodiment, the assemblable storage box comprises a flexible connection belt. A rear side of the box cover is rotatably connected to the rear side plate, the flexible connection belt is bendable, two ends of the flexible connection belt are respectively disposed with fasteners, a side edge of the box cover is disposed with a first lock hole at a position adjacent to a rotation axis between the box cover and the box body, a side plate of the four side plates disposed on the same side of the first lock hole is disposed with a second lock hole at a position adjacent to the rotation axis between the box cover and the box body, the fasteners of the two ends of the flexible connection belt are respectively disposed in the first lock hole and the second lock hole, and after the box cover is opened: the flexible connection belt is straightened, and connection lines of three points projected on a plane by the first lock hole, the second lock hole, and the rotation axis define an obtuse triangle.

In a preferred embodiment, the flexible connection belt is a three-step structure and comprises a body portion disposed on a middle portion and two connection portions disposed on two ends, the body portion and the connection portions are perpendicular to each other, the fasteners are respectively disposed on the two connection portions, and the flexible connection belt is integrally formed by polyethylene (PE), high density polyethylene (HDPE), or polypropylene (PP).

In a preferred embodiment, the flexible connection belt is disposed in the assemblable storage box.

In a preferred embodiment, the box cover comprises a plate and a frame disposed along four sides of the plate, a periphery of the plate of the box cover is connected to the frame of the box cover, the first lock hole is disposed on the frame, the four side plates comprise plates and rectangular frames disposed along four sides of the plates, peripheries of the plates of the four side plates are connected to the rectangular frames of the four side plates, and the second lock hole is disposed on the rectangular frame of one side plate of the four side plates.

Compared with the existing techniques, the technical solution has the following advantages.

1. Two adjacent side plates are detachably clamped together, and the positioning edges around the bottom plate are fastened together with the support countertop of the side plate through a positioning fastener, which is very convenient and quick to assemble. When disassembly is required, the bottom plate can be removed by removing the positioning fastener, and then the four side plates are separated. The side plates and the bottom plate can be stacked together for storage, which greatly reduces the occupied space and effectively prevents crushing.

2. The positioning column has an enlarged cap, and the enlarged cap of the positioning column is inserted from the wider end of the positioning hole during assembly and hung on the narrow end under the weight of the side plate. It is convenient to disassemble and assemble. As the free end of the positioning column is disposed with the enlarged cap, when the positioning column is hung on the narrow end of the positioning hole, the positioning column will not be disengaged to the positioning hole due to the enlarged cap, making the storage box strong and stable when in use.

3. Since the shaft core is detachable, the box cover can be assembled with the box body or the box cover can be removed for separate packaging.

4. After closing the box cover, the U-shaped fastener can fasten to the upper edge of the front side plate of the box body, forming a fixed point in the middle of the front side plate, which greatly strengthens the bending strength of the front side plate of the box body. The front side plate of the box body can withstand greater weight and is not easily arched outward, thereby improving the load-bearing capacity of the storage box. Also, the storage box can be used as a stool, and people can sit directly on the box cover, thereby solving the second technical problem mentioned in the deficiencies of the existing techniques.

5. The side wing covers the splice gap between the two adjacent side plates from the outer side, and the side wing can prevent water from penetrating into the assemblable storage box from the side, thereby solving the third technical problem mentioned in the deficiencies of the existing techniques. Moreover, by setting the side wings, sunlight can be prevented from entering into the assemblable box body and outdoor rodents and other insects can be prevented from crawling into the assemblable storage box.

6. The frictional force formed by the friction block can prevent the support rod from moving without external force, thereby maintaining the position of the box cover so that the box cover can stay at any desired opening angle, which is very convenient and safe to use. When the box cover needs to be opened and closed, the external force acting on the box cover is large enough to overcome the frictional force between the friction block and the support rod and pushes the support rod to slide, thereby enabling the box cover to rotate. The user only needs to overcome the frictional force between the friction block and the support rod to open the box cover to different angles, thereby solving the fourth technical problem mentioned in the deficiencies of the existing techniques.

7. The flexible connection belt is connected between the box body and the box cover, and the length of the flexible connection belt can enable the box cover to be angled at 90 degrees, but not more than 180 degrees, relative to the top of the box body. When the box cover is opened, the box cover can be rotated 90 degrees and less than 180 degrees and stay at a specific angle due to the connection belt. The operation is very convenient, thereby solving the fourth technical problem mentioned in the deficiencies of the existing techniques.

BRIEF DESCRIPTION OF THE DRAWINGS

The present disclosure will be further described below in combination with the accompanying drawings and embodiments.

DETAILED DESCRIPTION OF THE EMBODIMENTS

Embodiment 1

Figure 1:
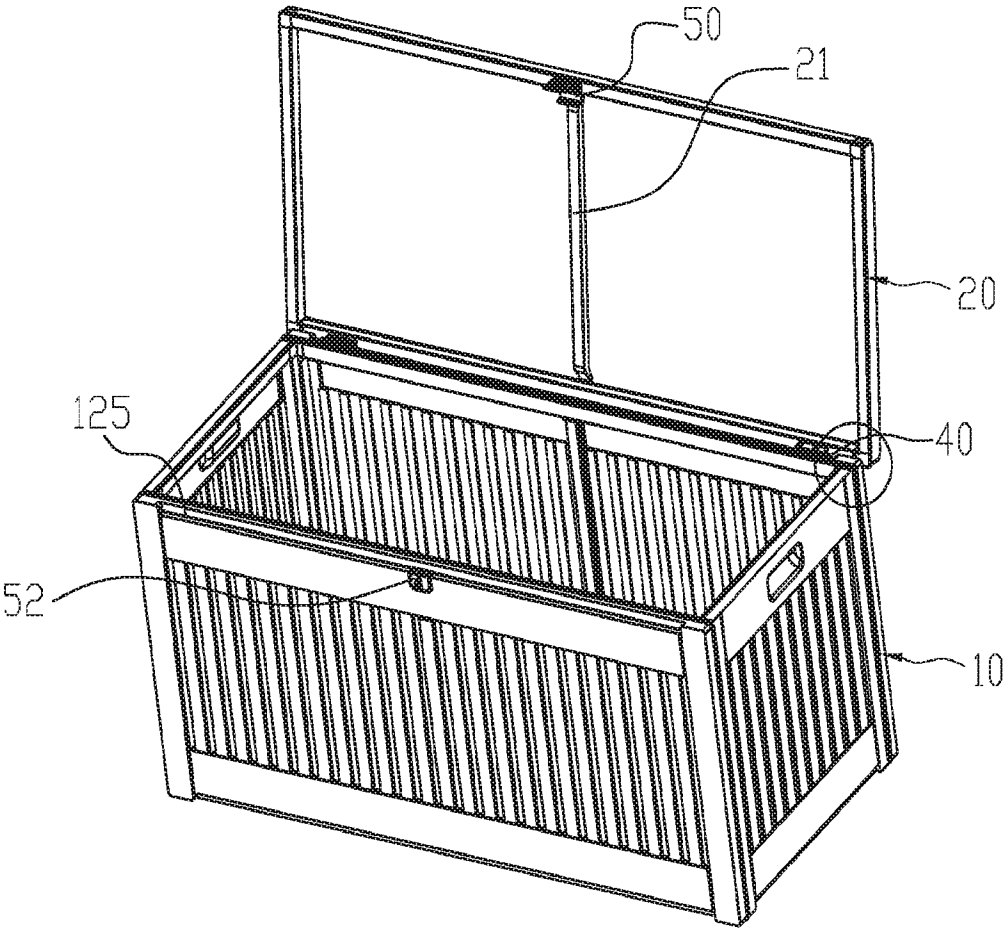
FIG. 1 illustrates a perspective view of an assemblable storage box of the present disclosure.

Referring to FIG. 1, an assemblable storage box of the present disclosure comprises a box body 10 comprising a top surface with an opening and a box cover 20 configured to cover the opening of the box body 10. After the box cover 20 is closed, the assemblable storage box has a rectangular hexahedron structure.

Figure 2:
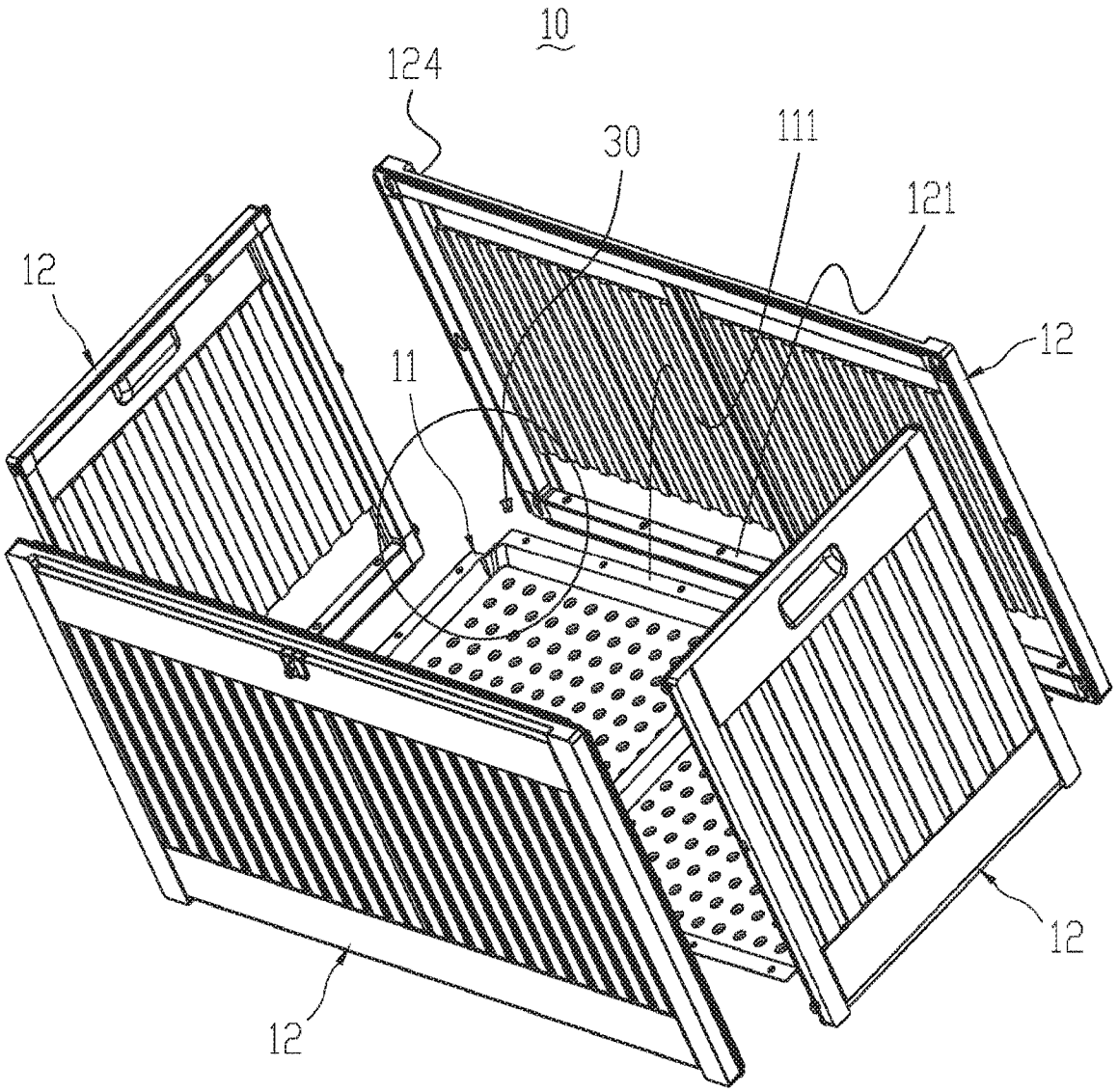
FIG. 2 illustrates an exploded perspective view of a box body of the assemblable storage box of the present disclosure.
Figure 3:
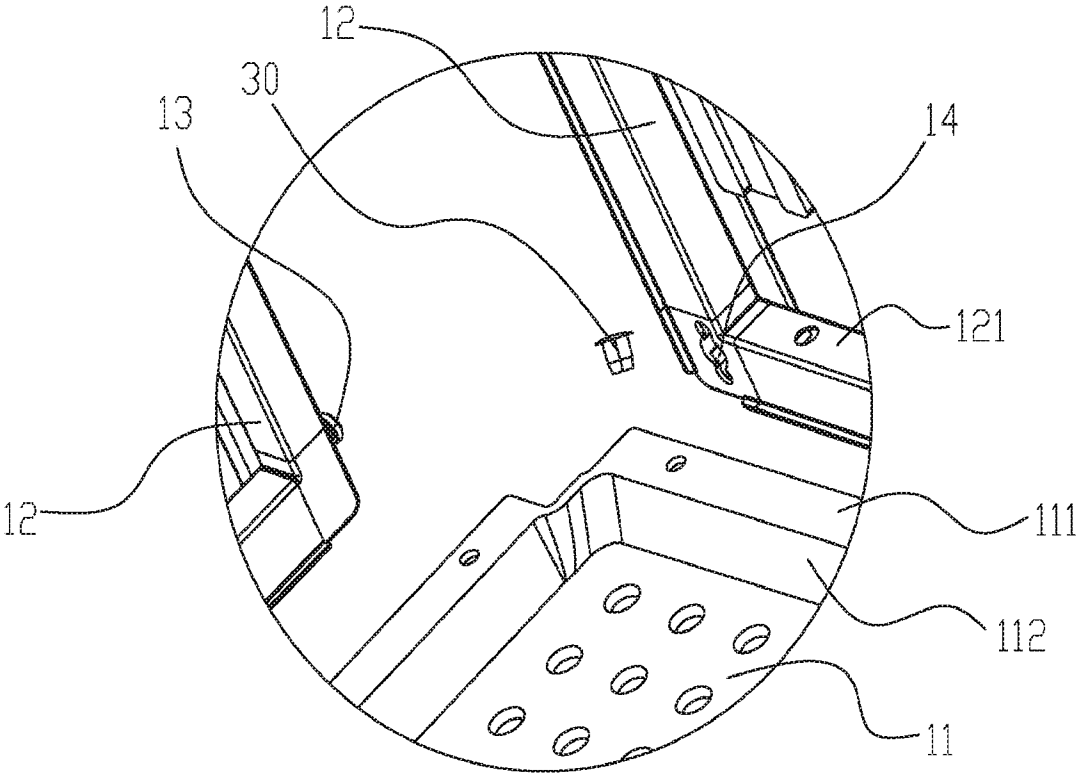
FIG. 3 illustrates an enlarged view of the circled portion of FIG. 2.
Figure 4:
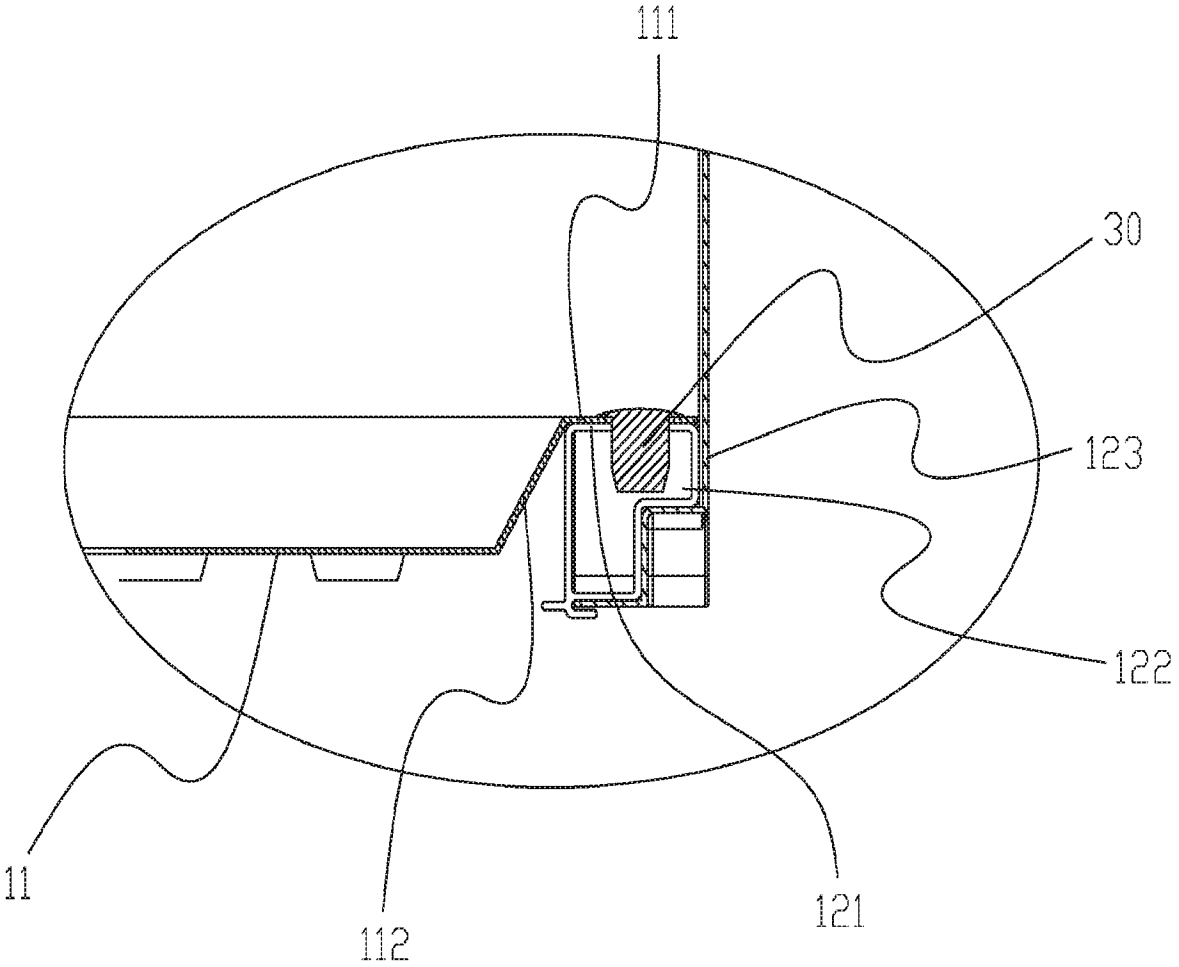
FIG. 4 illustrates a connection between a bottom plate and a side plate of the assemblable storage box of the present disclosure.

Referring to FIGS. 2-4, the box body 10 comprises a bottom plate 11 and four side plates 12 disposed on a front side, a rear side, a left side, and a right side of the box body 10. Two adjacent side plates 12 of the four side plates 12 are detachably clamped together, and the bottom plate 11 closes a bottom surface of the box body 10. Bottoms of the four side plates 12 disposed on the front side, the rear side, the left side, and the right side are all disposed with support countertops 121. Four sides of the bottom plate 11 respectively extend horizontally outward to define a positioning edge 111. The positioning edges 111 of the four sides of the bottom plate 11 respectively abut upper sides of the support countertops 121 of the four side plates disposed on the front side, the rear side, the left side, and the right side. The assemblable storage box also comprises a plurality of positioning fasteners 30, and the plurality of positioning fasteners 30 are fastened to the four side plates 12 to enable the positioning edges 111 to tightly abut the upper sides of the support countertops 121. Since the four side plates 12, comprising a front side plate, a rear side plate, a left side plate, and a right side plate, can be disassembled and assembled, after the plurality of positioning fasteners 30 are disassembled, the bottom plate can be removed. Therefore, assembly and disassembly are very convenient.

In a detailed embodiment, the two adjacent side plates 12 are clamped together by a positioning column 13 and a positioning hole 14. The positioning column 13 and the positioning hole 14 are respectively disposed on one of the two adjacent side plates 12. The positioning column 13 is connected to a side plate 12 of the two adjacent side plates 12 and a free end of the positioning column 13 comprises an enlarged cap. The positioning hole 14 is disposed on another side plate 12 of the two adjacent side plates 12 and is a gourd-shape hole. The cap of the positioning column 13 can be inserted from a wider end of the positioning hole 14 and hung on a narrower end of the positioning hole 14. A size of the wider end is larger than a size if the narrower end. The two side plates 12 disposed on the left side and the right side are sandwiched between the two side plates 12 disposed on the front side and the rear side. The positioning columns 13 are disposed on side surfaces of the two side plates 12 disposed on the left side and the right side, and the positioning holes 14 are disposed on edges of inner sides of the two side plates 12 disposed on the front side and the rear side. The positioning hole 14 comprise narrow tops and wide bottoms. When being clamped, the two side plates 12 disposed on the front side and the rear side are configured to lower downward due to their own weight to enable the positioning columns 13 to hang on the positioning holes 14. The bottom plate 11 is a blister board with honeycomb grooves. The four sides of the bottom plate 11 are all folded upward to define block edges 112, and upper edges of the block edges 112 horizontally extend outward to define the positioning edges 111. The four side plates 12 comprise rectangular frames 122 and plates 123. The rectangular frames 122 stand vertically, and four sides of the plates 123 surround the rectangular frames 122. Upper surfaces of bottom edges of the rectangular frames 122 define the support countertops 121 of the four side plates 12. In some embodiments, the plates 123 are blister boards, and the rectangular frames 122 are provided to provide strength to the side plates 12 while enabling the thicknesses of the side plates 12 to be reduced to not only save materials but also enable the box body 10 to be lighter. The rectangular frames 122 can be hollow plastic members, and the plurality of positioning fasteners 30 are also plastic members. The positioning edges 111 of the four sides of the bottom plate 11 are disposed with fixing holes, and the support countertops 121 of the four side plates 12 are disposed with mounting holes cooperating with the fixing holes. The plurality of positioning fasteners 30 are locked to the four side plates 12 by the fixing holes and the mounting holes to enable the bottom plate 11 to abut the support countertops 121 of the four side plates 12.

The box cover 20 is rotatably connected to one of the four side plates 12. The box cover 20 can be a structure that comprises an upper board, a lower board, and a frame disposed between the upper board and the lower board. Both the upper board and the lower board are blister boards. Pressure resistance and deformation resistance of the box cover 20 can be stronger due to the two-layer board structure (e.g., comprising the upper board and the lower board), so that when the storage box is assembled and used, an upper side of the box cover 20 can be stacked with items or function as a seat.

Figure 5:
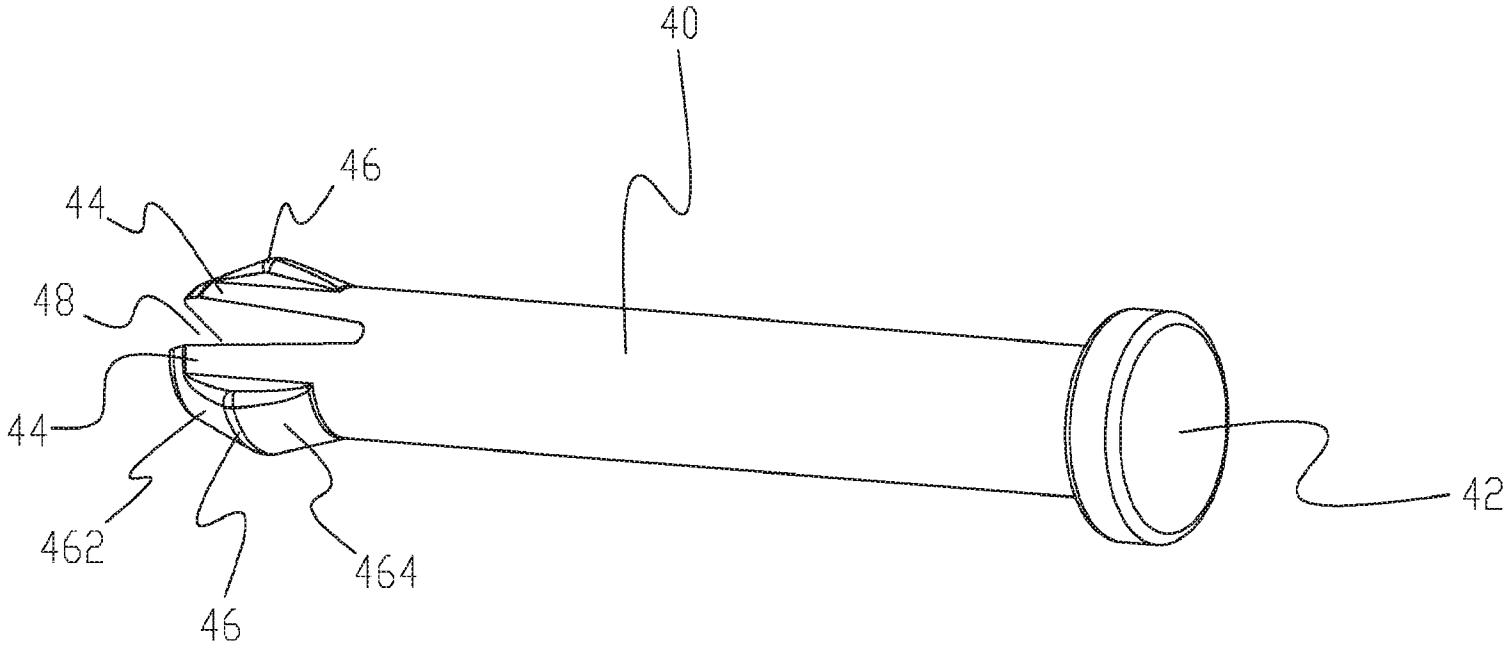
FIG. 5 illustrates a perspective view of a shaft core of the assemblable storage box of the present disclosure.

Referring to FIGS. 1 and 5, the box cover 20 is rotatably connected to the box body 10. A rear side edge of the box cover 20 is disposed with a connecting base, and a top edge of the rear side plate 12 of the box body 10 is also disposed with a connecting base. The connecting bases of the box cover 20 and the box body 10 are disposed with axial through holes that are coupled and aligned with each other. The assemblable storage box further comprise a shaft core 40, and the shaft core 40 enables the connecting bases of the box cover 20 and the box body 10 to be connected together. The shaft core 40 can be assembled and disassembled freely.

A first end of the shaft core 40 is disposed with a cap 42, and a second end of the shaft core 40 is centrally symmetrically disposed with two elastic arms 44 along an end surface of the shaft core 40. Opposite outer side walls of the two elastic arms 44 are respectively disposed with positioning protrusions 46. The shaft core 40 passes through the axial through hole of the box cover 20 and the axial through hole of the box body 10 and enables the connecting base of the box cover 20 to be connected to the connecting base of the box body 10. The cap 42 cooperates with the positioning protrusion 46 to clamp the connecting base of the box cover 20 and the connecting base of the box body 10. In this way, the two connecting bases can rotate freely about the shaft core 40 functioning as a rotation axis. The shaft core 40 is a plastic part integrally formed, and the positioning protrusion 46 has a front guide slope 462 and a rear guide slope 464. A V-shaped groove 48 is disposed on a middle portion of the end surface of the second end of the shaft core 40, and the V-shaped groove 48 divides the second end of the shaft core 40 into the two elastic arms 44. That is, the two elastic arms 44 and the shaft core 40 are an integral structure, and the V-shaped groove 48 enables the second end of the shaft core 40 to be more resistant to extrusion and to be difficult to break when the second end of the shaft core 40 is disposed in and separated from the axial through holes of the connecting bases. Two connecting bases are respectively fastened to the box cover 20 and the rear side plate 12 of the box body 10. The connecting base of the box cover 20 is disposed on the edge of the rear side of the bottom surface of the box cover 20. The connecting base of the box body 10 is disposed on the top portion of the rear side plate 12 of the box body 10. In some embodiments, an outer edge of a top surface of the rear side plate 12 is disposed with a step groove 124 (referring to FIG. 2), and the connecting base of the box body 10 is disposed in the step groove 124. The step groove 124 is disposed to give space to the connecting base of the box cover 20, so that the bottom surface of the box cover 20 can coincide with the top surface of the box body 10 when the box body 10 and the box cover 20 are in a closed state.

Figure 6:
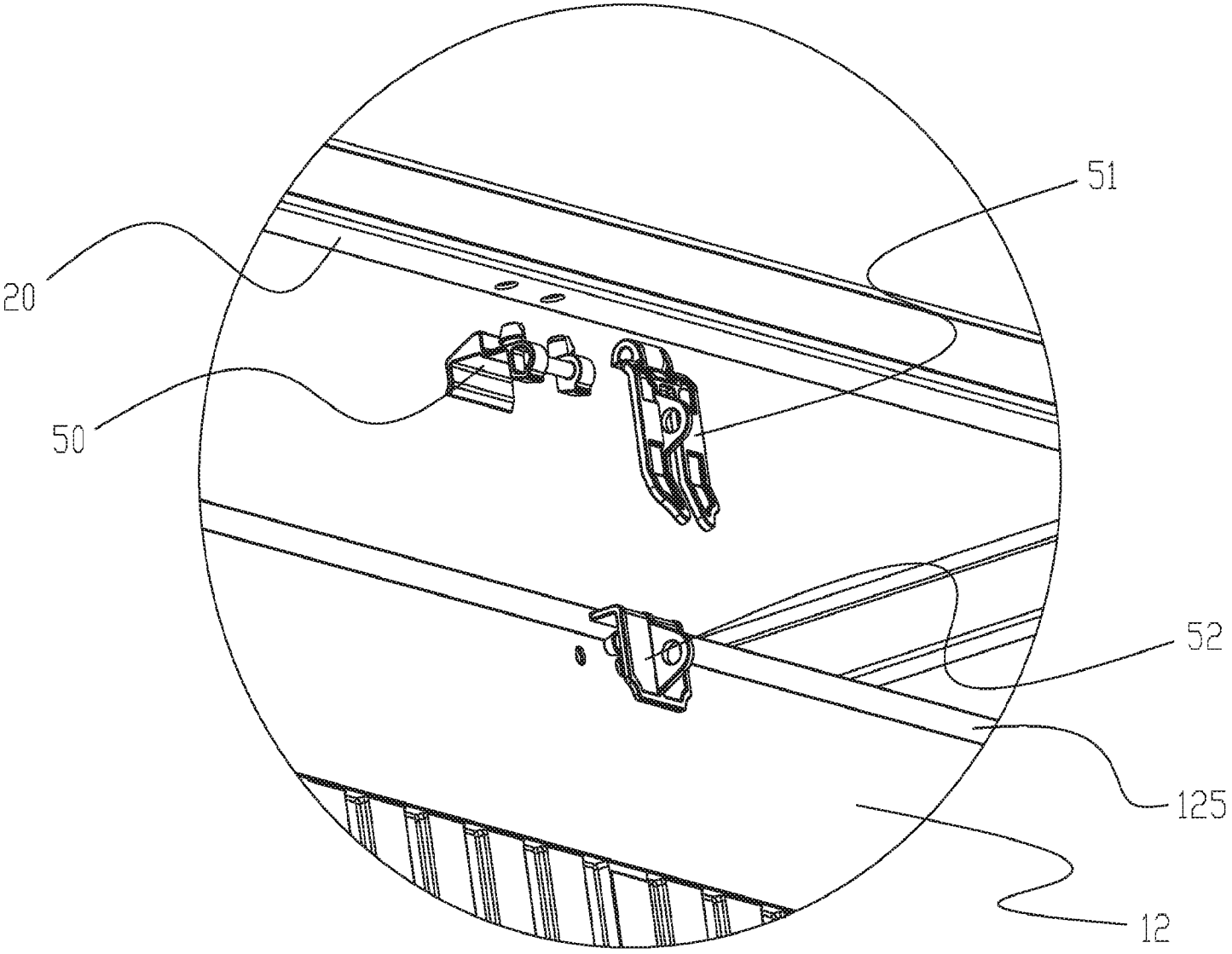
FIG. 6 illustrates an exploded view of a U-shaped fastener, a handle, and a lock piece of the assemblable storage box of FIG. 1.

Referring to FIG. 1 and FIG. 6, the assemblable storage box further comprises a U-shaped fastener 50 with an opening facing downward. The U-shaped fastener 50 is disposed below a middle portion of a front side of the box cover 20, and when the box cover 20 is closed, the U-shaped fastener 50 is fastened to an upper edge of the front side plate 12 of the box body 10. The U-shaped fastener 50 is configured to position to (e.g., connect to) an upper edge of the front side plate 12 of the box body 10, so that an anti-bending strength of the front side plate 12 is improved. An outer side of the upper edge of the front side plate 12 of the box body 10 is disposed with a step groove 125 and is further disposed with a handle 51 and a lock piece 52 configured to be mated and connected with each other. The handle 51 is rotatably connected to the U-shaped fastener 50, and the lock piece 52 is disposed on an edge position of the step groove 125. After the box cover 20 is closed, the handle 51 can be hung on and be connected to the lock piece 52.

In this embodiment, the box cover 20 comprises a plastic panel and a plastic frame, and four sides of the plastic panel are connected to the plastic frame. The U-shaped fastener 50 and the plastic frame are mated and connected together. The plastic frame is disposed with a first reinforcing rod 21 (referring to FIG. 1). The first reinforcing rod 21 divides the plastic frame into a left half and a right half, so that a strength of the box cover 20 is increased. In some embodiments, the rectangular frame 122 of the front side plate 12 of the box body 10 is disposed with a second reinforcing rod, and the second reinforcing rod is vertically disposed on a middle portion of the rectangular frame 122 so that an anti-bending strength of the front side plate 12 is increased.

Figure 7:
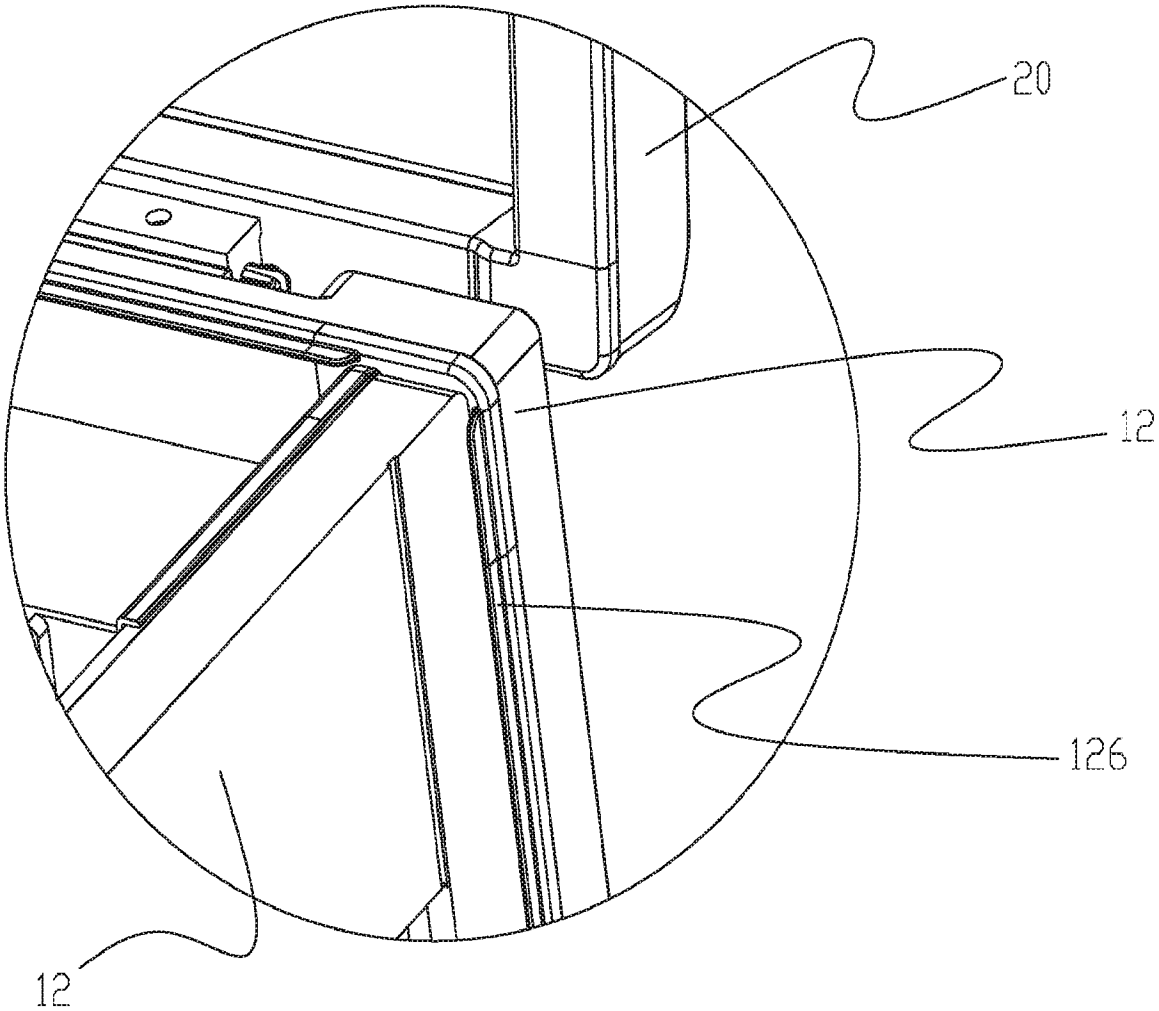
FIG. 7 illustrates an enlarged view of the circled portion of FIG. 1.
Figure 8:
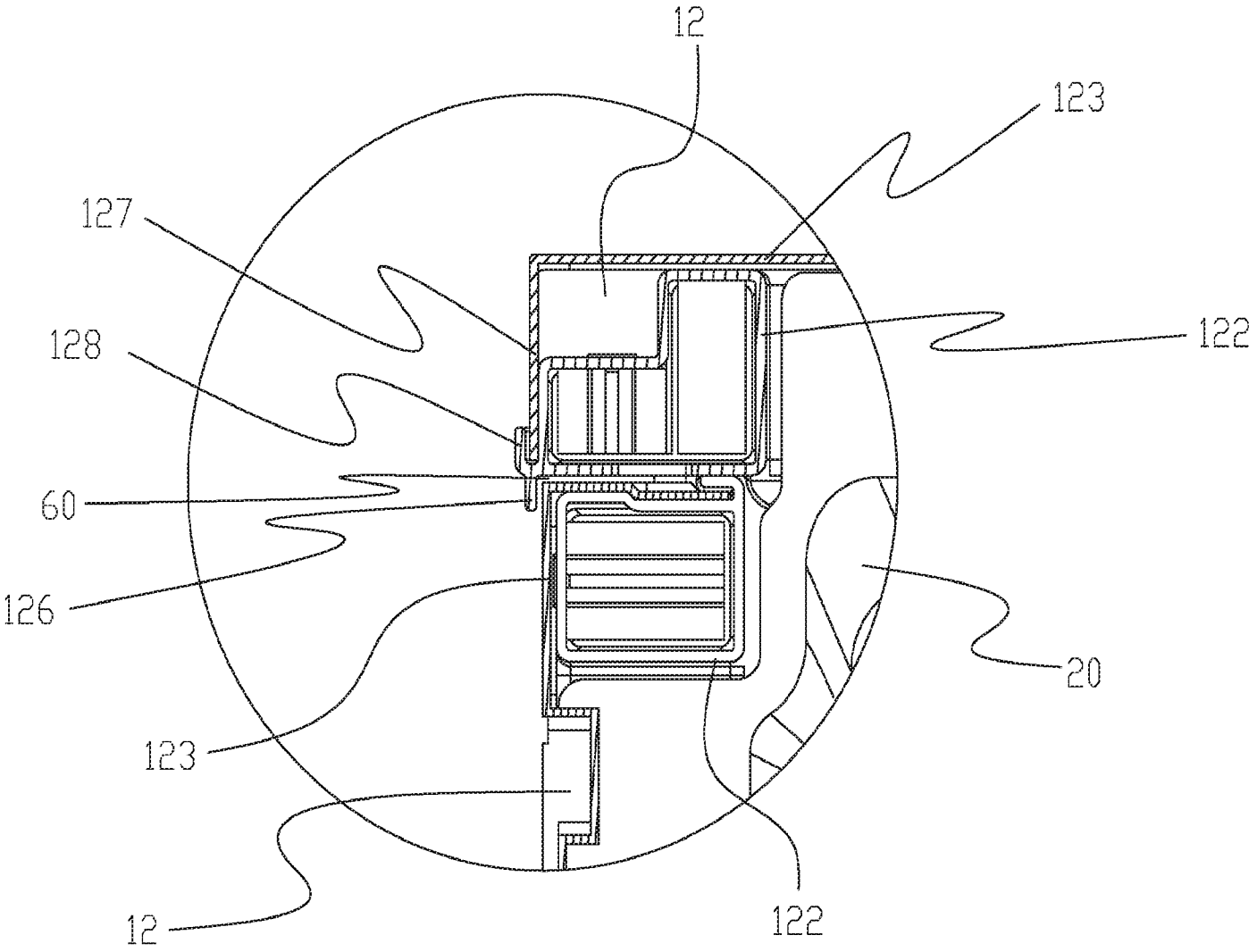
FIG. 8 illustrates a connection between two adjacent side plates of the assemblable storage box of the present disclosure.

Referring to FIGS. 7 and 8, a splice gap 60 is defined between the two adjacent side plates 12. As mentioned above, the four side plates 12 comprise plates 123 and rectangular frames 122 connected together. The rectangular frames 122 are disposed along the edges of the four sides of the plates 123. In the two adjacent side plates 12, the rectangular frame 122 of one side plate 12 extends outward to define a side wing 126. The side wing 126 is a long, strip structure vertically disposed, and the side wing 126 covers the splice gap 60 between the two adjacent side plates 12 from an outer side. Four sides of the plates 123 bend inward to define folded edges 127, and the folded edges 127 surround the rectangular frames 122 from the outer side. The rectangular frames 122 are disposed with pressing edges 128 configured to press edges of the folded edges 127. The folded edges 127 of the plates 123 are pressed by the pressing edges 128 of the rectangular frames 122. In this way, the plates 123 are more tightly attached to the rectangular frames 122, so that an overall structure is more compact and stable. As the front side plate 12 and the rear side plate 12 clamp the left side plate 12 and the right side plate 12, in this embodiment, the side wings 126 are defined on the rectangular frames 122 of the front side plate 12 and the rear side plate 12.

Figure 9:
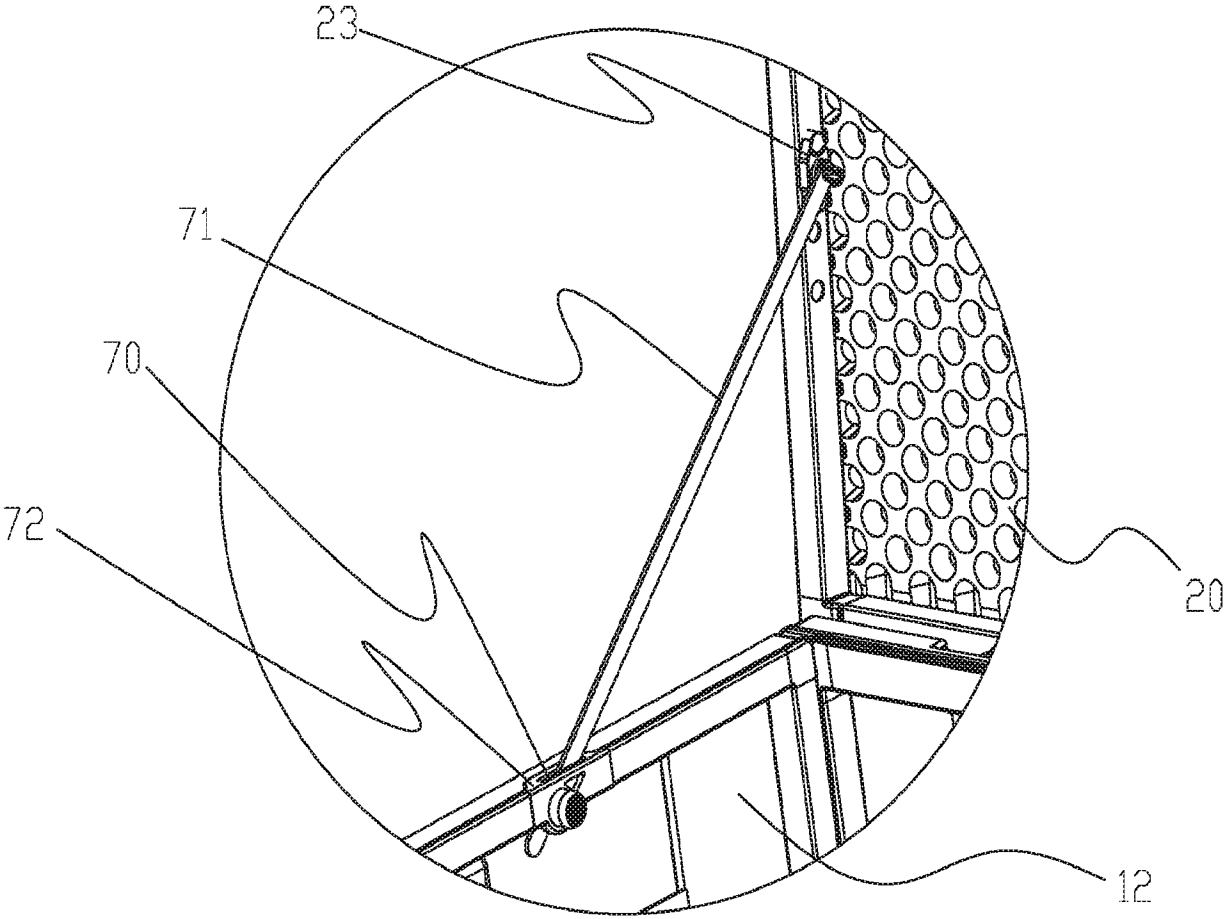
FIG. 9 illustrates a self-positioning structure configured to support a box cover of the assemblable storage box of the present disclosure.
Figure 10:
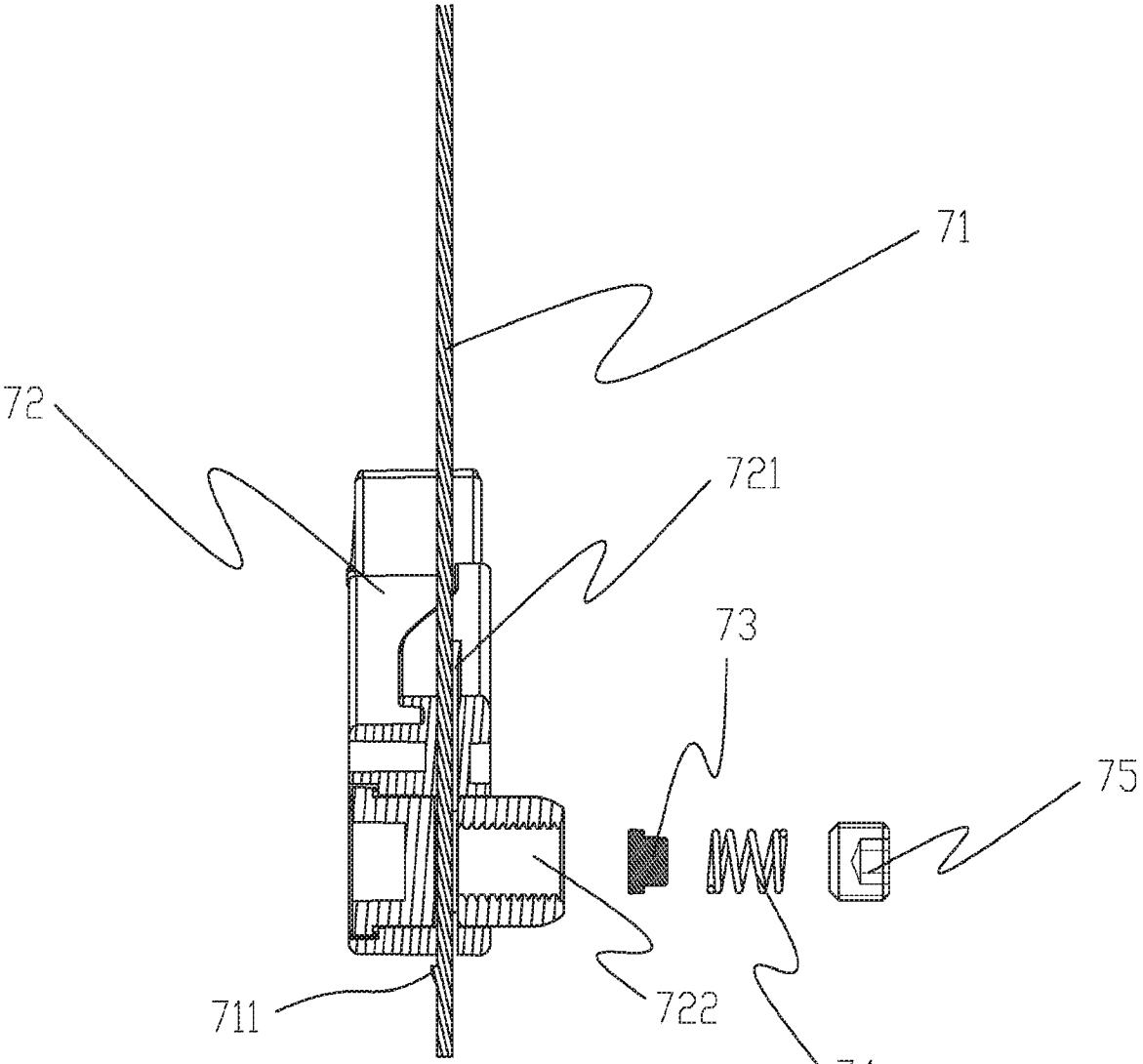
FIG. 10 illustrates an exploded view of the self-positioning structure of FIG. 9.

Referring to FIGS. 9 and 10, in order to enable the box cover 20 to be opened and to be maintained at a predetermined position, a self-positioning structure 70 is disposed between the box cover 20 and the left side plate 12 or the right side plate 12. The self-positioning structure 70 comprises a support rod 71, a fixing base 72, and a friction block 73. The fixing base 72 is disposed on one of the four side plates 12 of the box body 10. The fixing base 72 is disposed with a slide groove 721 passing through an upper top surface and a lower bottom surface of the fixing base 72, and the fixing base 72 is further disposed with a receiving hole 722 in communication with the slide groove 721. A first end of the support rod 71 is pivotally connected to a side wall of the box cover 20, and a second other end of the support rod 71 passes through the slide groove 721. A width of the slide groove 721 is greater than a width of the support rod 71, and the support rod 71 can slide and swing relative to the slide groove 721. The friction block 73 is disposed in the receiving hole 722 and is in friction connection with and cooperates with the support rod 71. The support rod 71 is positioned due to the frictional force between the friction block 73 and the support rod 71, and the support rod 71 can be pulled to move by overcoming the frictional force. An inner surface of the receiving hole 722 is disposed with an internal thread, and the self-positioning structure 70 further comprises an elastic member 74 and a screw bolt 75 cooperating with the internal thread. Two ends of the elastic member 74 respectively abut the friction block 73 and the screw bolt 75. The screw bolt 75 rotates to adjust the frictional force between the friction block 73 and the support rod 71 so that the frictional force between the friction block 73 and the support rod 71 is easily adjusted for various sizes of the box cover 20. An end of the second end of the support rod 71 is disposed with a positioning hook 711 configured to prevent the support rod 71 and the slide groove 721 from separating from each other. Therefore, when the box cover 20 is opened, the box cover 20 can only be opened to a preset maximum angle. That is, the positioning hook 711 is clamped to the fixing base 72, and the support rod 71 will not be drawn out of the slide groove 721 even where a user opens the box cover 20 with excessive force.

In some embodiments, the box cover 20 is disposed with a hinge base 23, and the first end of the support rod 71 is pivotally connected to the hinge base 23. The hinge base 23 is disposed with a positioning pin, the plastic frame of the box cover 20 comprises a plurality of positioning holes cooperating with the positioning pin, and the positioning pin is clamped to one of the plurality of positioning holes. The maximum angle of the box cover 20 can be preset using the plurality of positioning holes, and the preset maximum angle of the box cover 20 is easily adjusted. An entirety of the support rod 71 is disposed in a receiving space defined by the box body 10 and the box cover 20. When the box cover 20 is closed, an appearance of the box body 10 is tidier, and the support rod 71 is prevented from hooking or catching other surrounding objects. In some embodiments, the support rod 71, the fixing base 72, and the hinge base 23 are all plastic elements.

Figure 11:
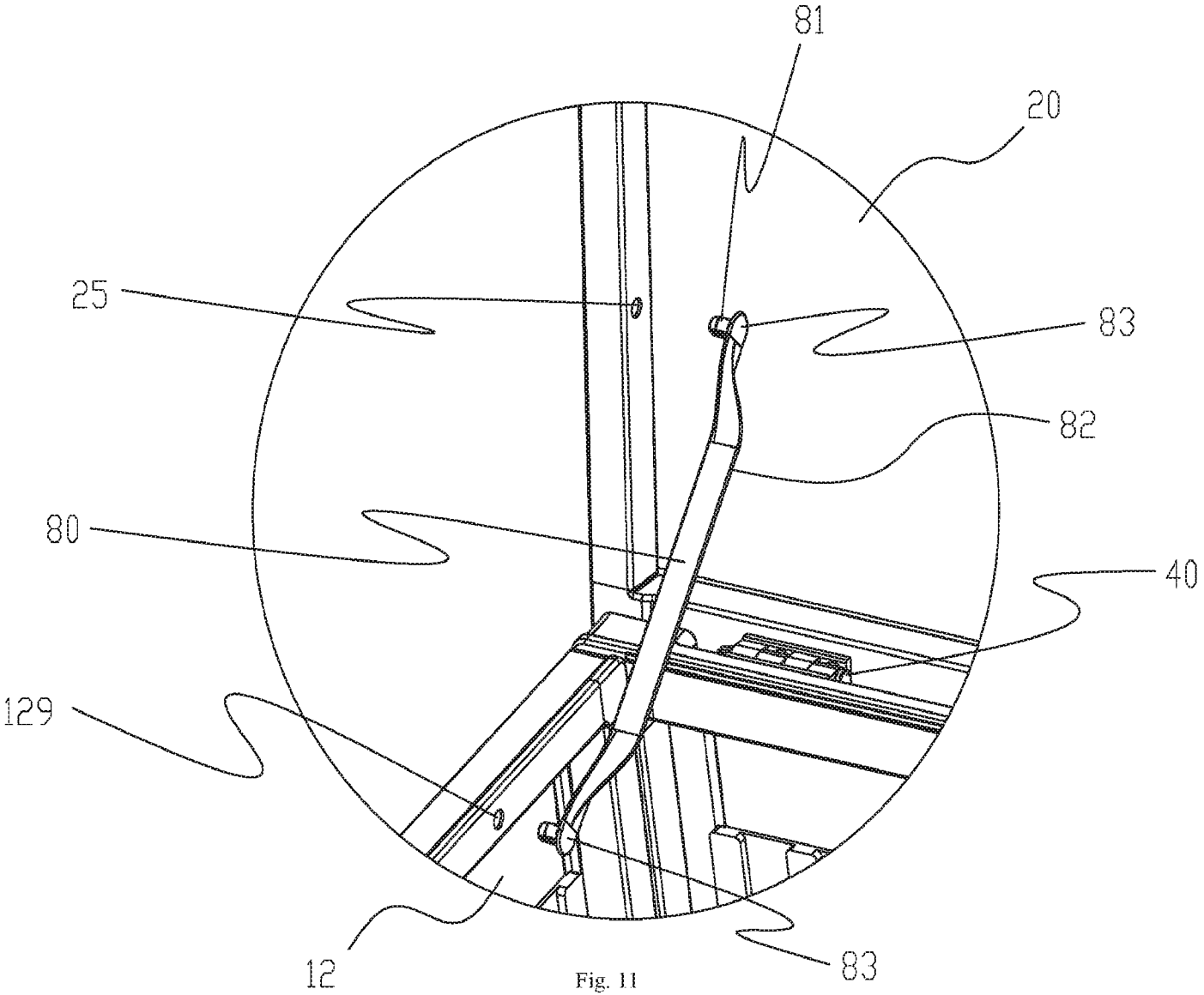
FIG. 11 illustrates a flexible connection belt configured to support the box cover of the assemblable storage box of the present disclosure.

Referring to FIG. 11, where the self-positioning structure 70 is not present and there is a desired for the box cover 20 to be maintained at a specified position after the box cover 20 is opened, a flexible connection belt 80 can also be disposed between the box cover 20 and the box body 10. The flexible connection belt 80 can be bent, and two ends of the flexible connection belt 80 are respectively disposed with fasteners 81. A side edge of the box cover 20 is disposed with a first lock hole 25 at a position adjacent to a rotation axis (that is, the shaft core 40) between the box cover 20 and the box body 10, and the side plate 12 of the box body 10 on the same side of the first lock hole 25 is disposed with a second lock hole 129 at a position adjacent to the rotation axis. The fasteners 81 of the two ends of the flexible connection belt 80 are respectively disposed in the first lock hole 25 and the second lock hole 129. After the box cover 20 is opened, the flexible connection belt 80 is straightened, and connecting lines of three points projected on a plane by the first lock hole 25, the second lock hole 129, and the rotation axis define an obtuse triangle. That is, a length of the flexible connection belt 80 enables the box cover 20 to be turned more than 90 degrees, but not more than 180 degrees. Therefore, after the box cover 20 is opened, the box cover 20 can be stably maintained in the open position due to its own weight and a pulling force of the flexible connection belt 80.

The flexible connection belt 80 is a three-step structure and comprises a body portion 82 disposed on a middle portion and two connection portions 83 disposed on two ends. The body portion 82 and the two connection portions 83 are perpendicular to each other. Two fasteners 81 are respectively disposed on the two connection portions 83, and the two fasteners 81 and the body portion 82 are disposed on two sides of the two connection portions 83. The flexible connection belt 80 is integrally formed by polyethylene (PE), high density polyethylene (HDPE), or polypropylene (PP). The flexible connection belt 80 is disposed in the assemblable storage box to enable the flexible connection belt 80 to be disposed in the box body 10 when the box cover 20 is closed.

The aforementioned embodiments are merely some embodiments of the present disclosure, and the scope of the disclosure of is not limited thereto. Thus, it is intended that the present disclosure cover any modifications and variations of the presently presented embodiments provided they are made without departing from the appended claims and the specification of the present disclosure.

What is claimed is:

1. An assemblable storage box, comprising:
a box body comprising a top surface with an opening,
a box cover configured to cover the opening of the box body, and
positioning fasteners, wherein:
the box body comprises a bottom plate and four side plates,
the four side plates comprise a front side plate, a rear side plate, a left side plate, and a right side plate,
two adjacent side plates of the four side plates are detachably clamped together by positioning columns and positioning holes,
the positioning columns and the positioning holes are respectively disposed on one of the two adjacent side plates,
free ends of the positioning columns comprise caps,
the positioning holes are gourd shaped,
the caps of the positioning columns are configured to be disposed in and hung on narrower ends of the positioning holes from wider ends of the positioning holes,
bottom portions of the four side plates are disposed with support countertops,
four sides of the bottom plate horizontally extend outward to define positioning edges,
the positioning edges of the four sides of the bottom plate respectively abut the support countertops of the four side plates, and
the positioning fasteners are fastened to the support countertops to enable the positioning edges to be positioned relative to the support countertops.

2. The assemblable storage box according to claim 1, wherein:
the left side plate and the right side plate are clamped between the front side plate and the rear side plate,
inner surfaces of the left side plate and the right side plate are disposed with the positioning columns,
end faces of the front side plate and the rear side plate are disposed with the positioning holes, and
the positioning holes comprises narrow tops and wide bottoms.

3. The assemblable storage box according to claim 1, wherein:
the four sides of the bottom plate are all folded upward to define block edges, and
upper edges of the block edges horizontally extend outward to define the positioning edges.

4. The assemblable storage box according to claim 3, wherein:
the four side plates comprise rectangular frames and plates,
four sides of the plates extend towards the rectangular frames to surround outer surfaces and bottom surfaces of the rectangular frames, and
upper surfaces of bottom edges of the rectangular frames define the support countertops of the four side plates.

5. The assemblable storage box according to claim 4, wherein:
the bottom plate is a blister board, and
the bottom plate is disposed with honeycomb grooves.

6. The assemblable storage box according to claim 1, wherein:
a splice gap is defined between the two adjacent side plates,
the four side plates comprise rectangular frames and plates connected together,
the rectangular frames are disposed along edges of four sides of the plates, and
in the two adjacent side plates connected end-to-end:
the rectangular frame of one side plate of the two adjacent side plates extends outward to define a side wing, and
the side wing covers the splice gap between the two adjacent side plates from an outer side.

7. The assemblable storage box according to claim 6, wherein:
the plates are plastic blister boards, and
the rectangular frames are hollow plastic members.

8. The assemblable storage box according to claim 7, wherein:
the four sides of the plates are bent inward to define folded edges,
the folded edges surround the rectangular frames from the outer side,
the rectangular frames are disposed with pressing edges, and
the pressing edges press edges of the folded edges.

9. The assemblable storage box according to claim 6, wherein:
the left side plate and the right side plate are clamped by the front side plate and the rear side plate, and
the rectangular frames of the front side plate and the rear side plate define the side wings.

10. The assemblable storage box according to claim 1, wherein:
a rear side of the box cover is rotatably connected to the rear side plate,
a self-positioning structure is disposed between the box cover and the left side plate or the right side plate,
the self-positioning structure comprises a support rod, a fixing base, and a friction block, the fixing base is disposed on the left side plate or the right side plate, the fixing base is disposed with a slide groove passing through an upper top surface and a lower bottom surface of the fixing base, the fixing base is further disposed with a receiving hole in communication with the slide groove, a first end of the support rod is pivotally connected to a side wall of the box cover, a second end of the support rod passes through the slide groove and extends out of the fixing base in a downward direction, the support rod is configured to slide and swing relative to the slide groove, the friction block is disposed in the receiving hole and is in friction connection with the support rod, a frictional force between the friction block and the support rod positions the support rod, and the support rod is configured to be pulled to move by overcoming the frictional force.

11. The assemblable storage box according to claim 10, comprising:

an elastic member, and a screw bolt, wherein:

an inner surface of the receiving hole comprises an internal thread, the screw bolt cooperates with the internal thread, and two ends of the elastic member abut the friction block and the screw bolt respectively.

12. The assemblable storage box according to claim 10, wherein an end of the second end of the support rod is disposed with a positioning hook configured to prevent the support rod from being separated from the slide groove.

13. The assemblable storage box according to claim 10, wherein:

the box cover is disposed with a hinge base, and the first end of the support rod is pivotally connected to the hinge base.

14. The assemblable storage box according to claim 13, wherein:

the hinge base is disposed with a positioning pin, the box cover comprises a plurality of positioning holes configured to cooperate with the positioning pin, and the positioning pin is configured to be clamped to one of the plurality of positioning holes.

15. The assemblable storage box according to claim 10, wherein, after the box cover is closed, the support rod is disposed in the box body.

16. The assemblable storage box according to claim 1, comprising:

a flexible connection belt, wherein:

a rear side of the box cover is rotatably connected to the rear side plate, the flexible connection belt is bendable, two ends of the flexible connection belt are respectively disposed with fasteners, a side edge of the box cover is disposed with a first lock hole at a position adjacent to a rotation axis between the box cover and the box body, a side plate of the four side plates disposed on the same side of the first lock hole is disposed with a second lock hole at a position adjacent to the rotation axis between the box cover and the box body, the fasteners of the two ends of the flexible connection belt are respectively disposed in the first lock hole and the second lock hole, and after the box cover is opened:

the flexible connection belt is straightened, and connection lines of three points projected on a plane by the first lock hole, the second lock hole, and the rotation axis define an obtuse triangle.

17. The assemblable storage box according to claim 16, wherein:

the flexible connection belt is a three-step structure and comprises a body portion disposed on a middle portion and two connection portions disposed on two ends, the body portion and the two connection portions are perpendicular to each other, the fasteners are respectively disposed on the two connection portions, and the flexible connection belt is integrally formed by polyethylene (PE), high density polyethylene (HDPE), or polypropylene (PP).

18. The assemblable storage box according to claim 16, wherein the flexible connection belt is disposed in the assemblable storage box.

19. The assemblable storage box according to claim 18, wherein:

the box cover comprises a plate and a frame disposed along four sides of the plate, a periphery of the plate of the box cover is connected to the frame of the box cover, the first lock hole is disposed on the frame, the four side plates comprise plates and rectangular frames disposed along four sides of the plates, peripheries of the plates of the four side plates are connected to the rectangular frames of the four side plates, and the second lock hole is disposed on the rectangular frame of one side plate of the four side plates.

20. An assemblable storage box, comprising:

a box body comprising a top surface with an opening, a box cover configured to cover the opening of the box body, and positioning fasteners, wherein:

the box body comprises a bottom plate and four side plates, the four side plates comprise a front side plate, a rear side plate, a left side plate, and a right side plate, two adjacent side plates of the four side plates are detachably clamped together, bottom portions of the four side plates are disposed with support countertops, four sides of the bottom plate horizontally extend outward to define positioning edges, the positioning edges of the four sides of the bottom plate respectively abut the support countertops of the four side plates, the positioning fasteners are fastened to the support countertops to enable the positioning edges to be positioned relative to the support countertops, the bottom plate is a blister board, and the bottom plate is disposed with honeycomb grooves.

21. An assemblable storage box, comprising:

a box body comprising a top surface with an opening, a box cover configured to cover the opening of the box body, and positioning fasteners, wherein:

the box body comprises a bottom plate and four side plates, the four side plates comprise a front side plate, a rear side plate, a left side plate, and a right side plate, two adjacent side plates of the four side plates are detachably clamped together, bottom portions of the four side plates are disposed with support countertops, four sides of the bottom plate horizontally extend outward to define positioning edges, the positioning edges of the four sides of the bottom plate respectively abut the support countertops of the four side plates, the positioning fasteners are fastened to the support countertops to enable the positioning edges to be positioned relative to the support countertops, a splice gap is defined between the two adjacent side plates, the four side plates comprise rectangular frames and plates connected together, the plates are plastic blister boards, the rectangular frames are hollow plastic members, the rectangular frames are disposed along edges of four sides of the plates, and in the two adjacent side plates connected end-to-end:

the rectangular frame of one side plate of the two adjacent side plates extends outward to define a side wing, and the side wing covers the splice gap between the two adjacent side plates from an outer side.

* * * * *